US007561123B2

(12) United States Patent
Satoh

(10) Patent No.: US 7,561,123 B2
(45) Date of Patent: Jul. 14, 2009

(54) METHOD OF DRIVING DISPLAY PANEL AND DRIVE FOR CARRYING OUT SAME

(75) Inventor: Shinichi Satoh, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 444 days.

(21) Appl. No.: 10/669,446

(22) Filed: Sep. 25, 2003

(65) Prior Publication Data

US 2004/0201554 A1 Oct. 14, 2004

(30) Foreign Application Priority Data

Apr. 10, 2003 (JP) ..... 2003-106985

(51) Int. Cl.
*G09G 3/30* (2006.01)

(52) U.S. Cl. ..... 345/76; 345/77; 345/204; 315/169.3

(58) Field of Classification Search ..... 345/76–77, 345/204; 315/169.3
See application file for complete search history.

(56) References Cited

U.S. PATENT DOCUMENTS 6,545,652 B1 * 4/2003 Tsuji ..... 345/82
6,617,801 B2 * 9/2003 Ishizuka et al. ..... 315/169.3
6,922,182 B2 * 7/2005 Sase ..... 345/76

FOREIGN PATENT DOCUMENTS

| | | |
|---|---|---|
| JP | 09-292858 | 11/1997 |
| JP | 2000-187467 | 7/2000 |
| JP | 2001-042828 | 2/2001 |

* cited by examiner

*Primary Examiner*—Richard Hjerpe
*Assistant Examiner*—Leonid Shapiro
(74) *Attorney, Agent, or Firm*—Volentine & Whitt, P.L.L.C.

(57) ABSTRACT

A drive of a display panel, according to the invention, comprises first switching means $SEG_m$ for changing over between connection of the respective data lines SWsm to the side of respective variable current sources and connection thereof to a grounding side, second switching means SWc2 for changing over a potential of the respective scanning lines between a power supply potential $V_C$ and a grounding potential, a drive control circuit for controlling the first switching means and second switching means correspondingly to input data, a comparison circuit provided in each of the data lines, for outputting a control signal by comparing a potential from a voltage regulator with a potential of the respective data lines, and a current control circuit for controlling a current of the variable current source provided in each of the data lines based on results of comparison executed by the respective comparison circuit.

7 Claims, 7 Drawing Sheets

METHOD OF DRIVING DISPLAY PANEL AND DRIVE FOR CARRYING OUT SAME

FIELD OF THE INVENTION

The present invention relates to a method of driving a panel display and a drive for carrying out the method, and in particular, to a method of driving an organic EL panel, and a drive for carrying out the method.

BACKGROUND OF THE INVENTION

As shown in FIG. 1A, a driving circuit of an organic EL panel generally has a constant current source 11 and switching means $SW_{s1}$-$SW_{sm}$, respectively, for every data line, and a cathodic power supply potential $V_C$ and switching means $SW_{c1}$-$SW_{cn}$, respectively, for every scanning line, against the organic EL panel having an organic EL element $PE_{m,n}$, disposed at respective crossover points of a plurality of the data lines (anodic lines $SEG_1$-$SEG_m$) and a plurality of the scanning lines (cathodic lines $COM_1$-$COM_n$). These switching means are controlled by a drive control circuit 10 and can be turned into select state or unselect state, respectively.

In common operation to cause the organic EL panel to emit light for displaying, the switching means $SW_{cn}$ of the respective scanning lines $COM_n$ is turned ON (connected to a grounding potential $V_G$) and OFF (connected to the cathodic power supply potential $V_C$) in such a manner as to have operation waveforms shown in FIG. 2 at a predetermined time interval, thereby sequentially selecting panel rows to be lighted. At this time, the switching means SWsm of the data line $SEG_m$ connected to the organic EL element $PE_{m,n}$ to be lighted, in the panel row selected, is turned ON, and current is supplied thereto, whereupon the organic EL element $PE_{m,n}$ is caused to emit light.

Since emitted light luminance of the organic EL element $PE_{m,n}$ is dependent on a current value, values of current supplied to the respective data lines $SEG_m$ are required to be constant values equal to each other in order to avoid display unevenness.

In order to obtain a constant current, it is desirable that the driving circuit is under small effects of its dependency on an output voltage of the constant current source, a power supply voltage, manufacturing variations in constituent elements thereof, or so on.

A common structure of the organic EL element is as shown in FIG. 1B. Because a transparent, electrically conductive film (ITO film) as a constituent member thereof has resistance as large as about 10 to 20 Ω/•, the same is used on the side of the anodic data lines $SEG_m$ where a large current does not flow (on the order of several hundred μA to 1 mA) while a resistance material such as Al is used on the side of the cathodic scanning lines $COM_n$.

However, when causing all the elements in panel rows to emit light, a large current of several tens of mA flows in the direction of the grounding potential $V_G$ in the scanning lines $COM_n$ via the switching means $SW_{c1}$-$SW_{cn}$.

Even in the case of the scanning lines $COM_n$ using a resistance material such as an Al cathodic wiring, there flows a large current corresponding to the panel element connected thereto and a current value necessary for light emission, so that a voltage applied to the panel element $PE_{m,n}$ positioned at a more distal end in relation to the grounding potential $V_G$ becomes very high.

Assuming that resistance of the scanning lines $COM_n$ is $R_{m,n}$, a current flowing through the resistance is $I_{cm,n}$, ON resistance of the switching means $SW_{cn}$ is $SW_{rn}$, and a voltage applied to the organic EL element $PE_{m,n}$ when all the panel elements emit light is $V_{m,n}$ as shown in FIG. 3, the following equation results:

$$V_{m,n}=V_C+SW_{rn}*I_{c1,n}+R_{1,n}*I_{c1,n}+R_{2,n}*I_{c2,n}+\ldots+R_{m,n}*I_{cm,n}$$

Herein, assuming that light-emitting display panel rows are 128 rows, resistance between the panel elements is $R_{m,n}$=r (Ω), and a current supplied to respective data lines $SEG_m$ is Im=i (A), the following equation results:

$$V_{m,n} = V_C + SW_m * 128\,i + r * 128\,i + r * 127\,i + r * 126\,i + \ldots + ri$$

$$= V_C + SW_m * 128\,i + 8256ri$$

That is, there occurs a potential as high as 8256 ri (V) owing to the resistance component of the scanning lines $COM_n$.

Thus, since the farther from the grounding potential $V_G$ the EL element $PE_{m,n}$ is positioned at a distal end, the smaller a potential difference ΔV11 applied to the respective constant current sources 11 becomes, there have been cases where it becomes impossible to supply a constant current, depending on conditions such as dependency of the respective constant current sources 11 on output voltage, a constant current value, and a drive power supply voltage $V_s$.

Further, there is a tendency of an increase in the number of bits of a driver IC following an increase in the size of a panel screen, and such an increase in the number of the bits poses a problem in that not only deterioration in display unevenness, due to manufacturing variations, is brought about but also constant current characteristic dependent on resistance on the panel described above becomes susceptible to occurrence of faults.

SUMMARY OF THE INVENTION

The invention has been developed to resolve the problems encountered in the past, and it is an object of the invention to provide a method of driving a display panel, capable of preventing light emission faults from occurring to a panel by implementing stable supply of a constant current, and a drive for carrying out the method.

The invention provides in its first aspect a method of driving a display panel made up of (n×m) pieces of display elements each disposed at respective crossover points of a matrix, formed of n rows of scanning lines and m columns of data lines, wherein a current value of respective variable current sources for driving the respective data lines is controlled by comparing a potential of the respective data lines with a reference potential and based on results of such comparison.

Further, in accordance with a second aspect of the invention, there is provided a drive of a display panel comprising means for assuming during a display period of present display data a current correction value for each of the data lines in a succeeding display period on the basis a position of the date line, the number of the display elements, and a fixed value determined by the position of the date line, and current correction means for correcting a current value of the respective variable current sources on the basis of results of such assumption.

PREFERRED EMBODIMENTS OF THE INVENTION

Embodiments of the invention are described in detail hereinafter with reference to the accompanying drawings.

First Embodiment

Figure 4:
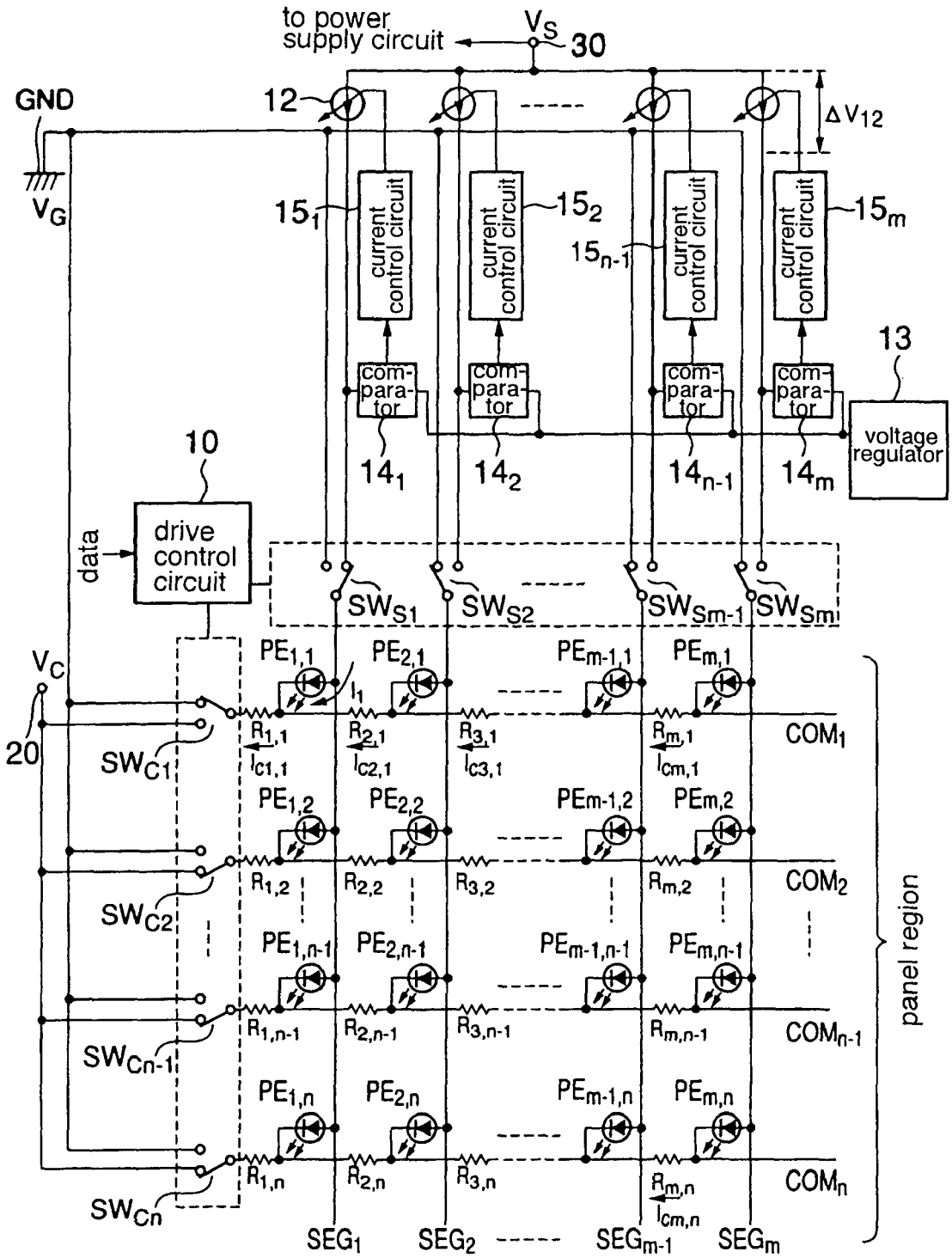
FIG. 4 is a circuit diagram of a drive of a display panel, according to a first embodiment of the invention.

FIG. 4 is a circuit diagram of a drive of a display panel, according to a first embodiment of the invention. As shown in the figure, a comparator 14*m* capable of comparing voltage levels with each other is connected to respective data lines $SEG_m$. The respective comparators 14*m* are connected to a voltage regulator 13 for generating a reference voltage. An output of the respective comparators 14*m* is connected to respective current control circuits 15*m* for controlling respective variable current sources 12. Assuming that current variation occurs when a voltage applied to the respective variable current sources 12 is ΔV12, the reference voltage of the voltage regulator 13 is set to a power supply voltage Vs-ΔV12. The respective comparators 14*m* are made up of a differential amplifier.

Figure 1A:
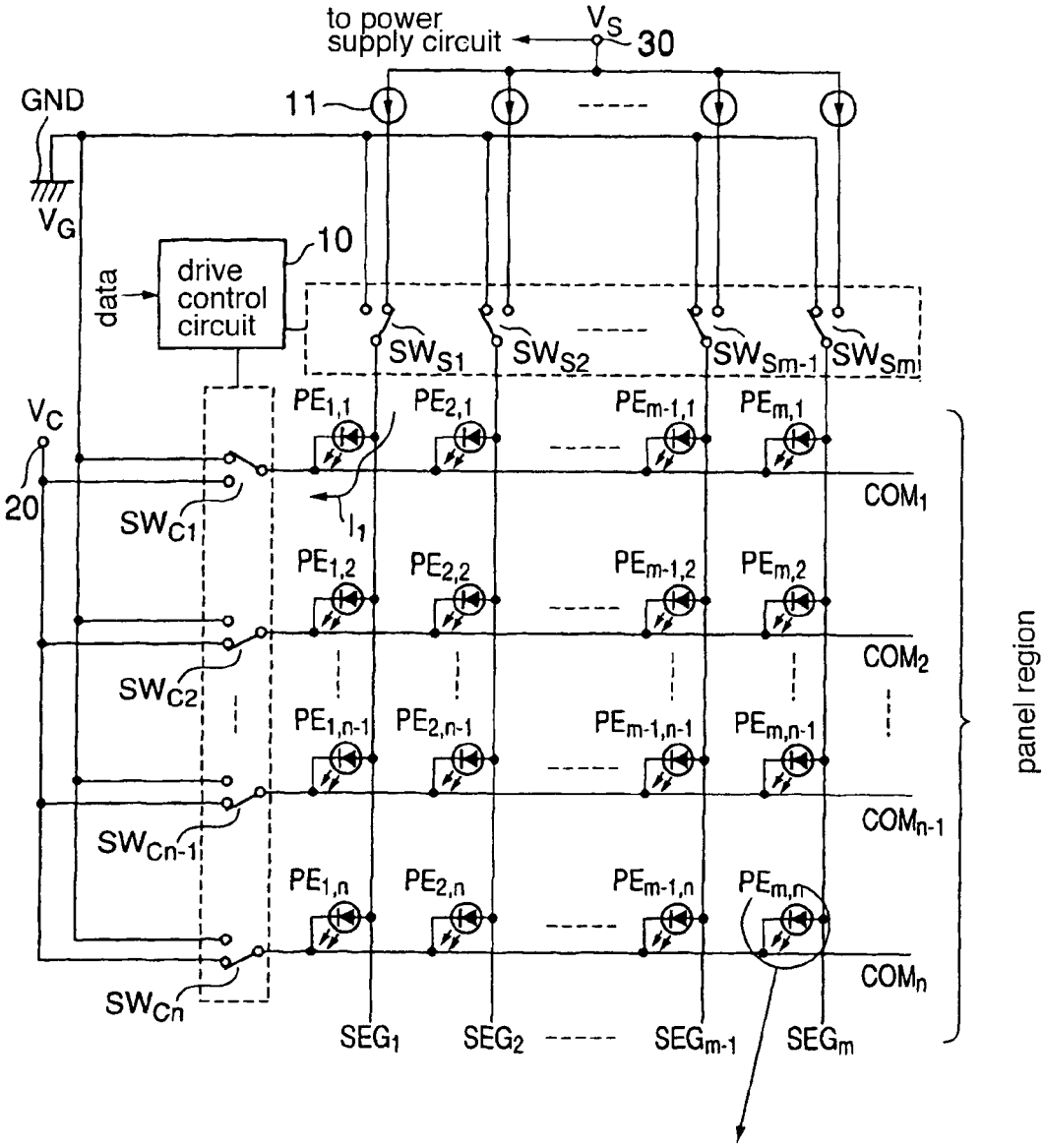
FIG. 1A (PRIOR ART)
FIG. 1A is a circuit diagram for illustrating a conventional technology.
Figure 1B:
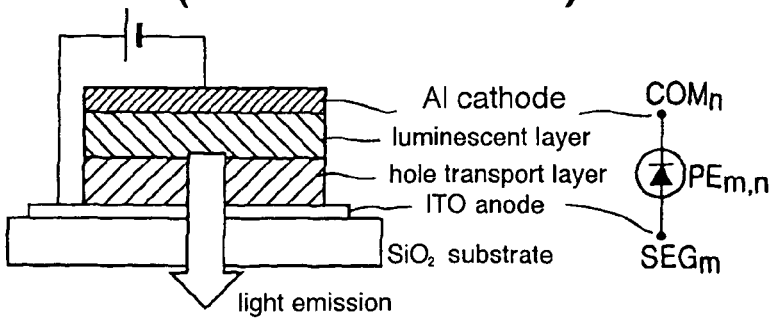
FIG. 1B (PRIOR ART)
FIG. 1B is a schematic representation showing the construction of an organic EL element by way of example.
Figure 2:
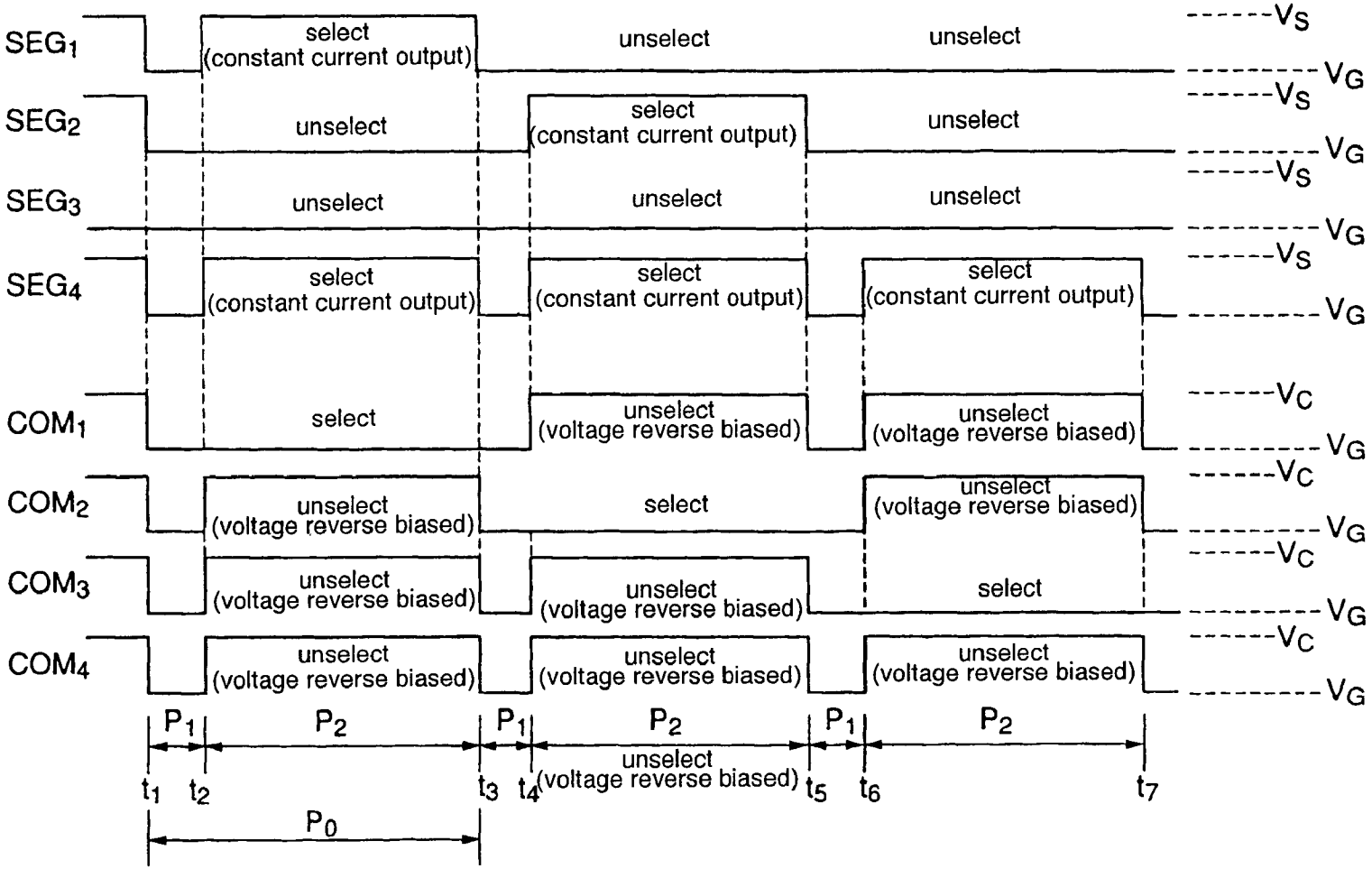
FIG. 2 is a waveform chart showing driving operation of a panel.
Figure 3:
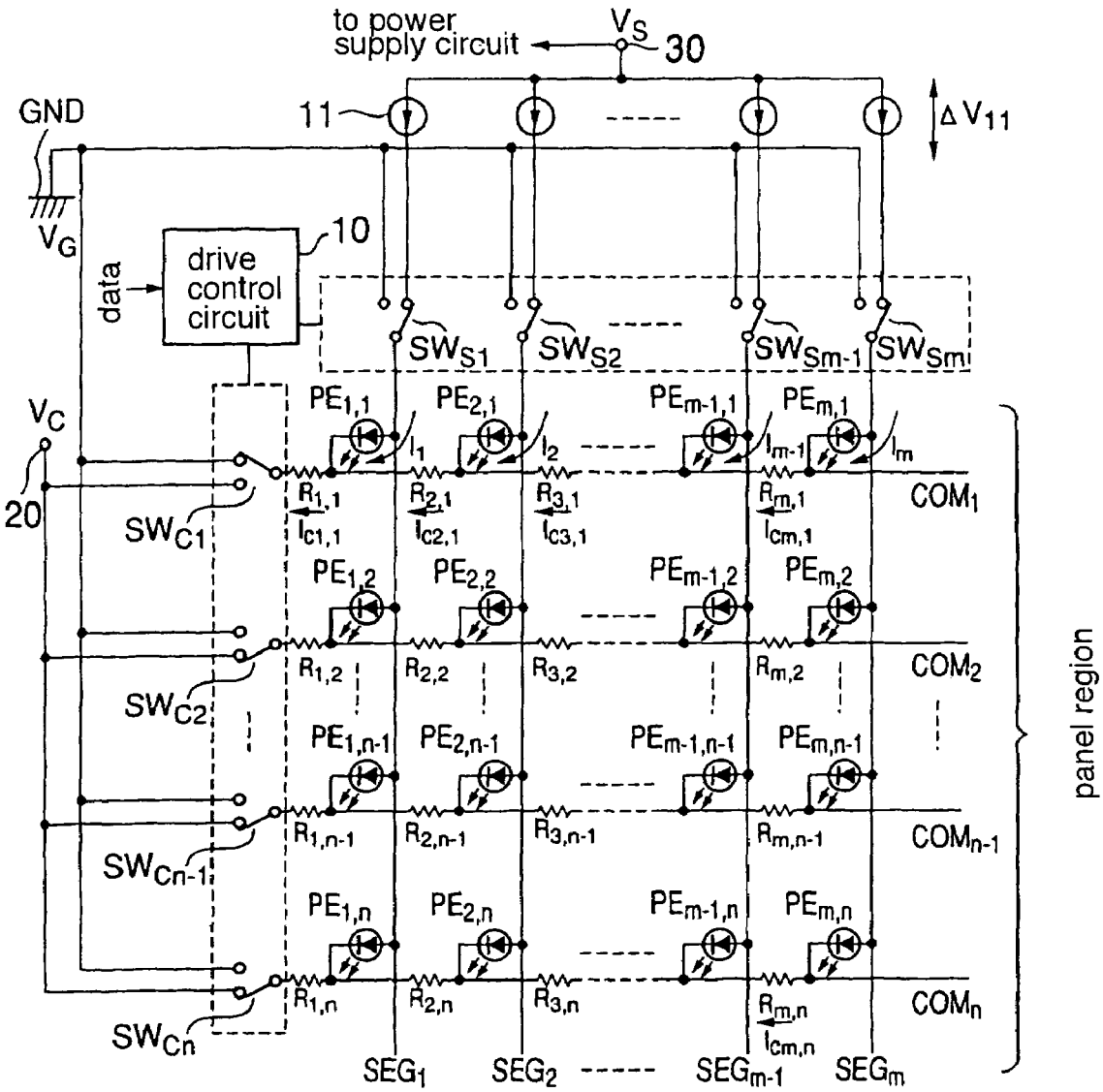
FIG. 3 (PRIOR ART)
FIG. 3 is a circuit diagram for illustrating problems encountered by conventional technology;.

Operation of the circuit of a configuration as described above is described hereinafter. Normal operation to cause the panel to emit light for displaying is executed by turning switching means $SW_{cn}$ of respective scanning lines $COM_n$ ON (connected to a grounding potential $V_G$) and OFF (connected to a cathodic power supply potential $V_C$) in such a manner as to have operation waveforms shown in FIG. 2 at a predetermined time interval, thereby sequentially selecting panel rows to be lighted. At this time, switching means SWsm of the data line $SEG_m$ connected to a panel element $PE_{m,n}$ to be lighted, in the panel row selected, is turned ON, and current is supplied thereto, whereupon the panel element $PE_{m,n}$ is caused to emit light.

At this time, a current at as large as several ten mA flows through the respective scanning lines $COM_n$ in the direction of the grounding potential $V_G$ via the switching means $SW_{cn1}$-$SW_{cn}$, respectively. Accordingly, a voltage applied to the panel element $PE_{m,n}$ disposed at a distal end from the grounding potential $V_G$ becomes very high.

Assuming that resistance of the scanning line $COM_n$ is $R_{m,n}$, a current flowing through the resistance is Icm,n, ON resistance of the switching means $SW_{cn}$ is $SW_{rm}$, ON resistance of the switching means SWsm is $SW_{rm}$ and a voltage applied to the organic EL element $PE_{m,n}$ when the panel in whole emits light is $V_{m,n}$, the following equation results:

$$V_{m,n}=V_C+SW_{rm}*I_{c1,n}+R_{1,n}*I_{c1,n}+R_{2,n}*I_{c2,n}+\ldots+R_{m,n}*I_{cm,n}+SW_{rm}*I_{cm,n}$$

so that when the applied voltage $V_{m,n}$ of the respective data lines $SEG_m$ becomes higher than an output voltage of the voltage regulator 13, a decrease in current is detected by the respective comparators 14*m* made up of the differential amplifier, thereby increasing current of the respective variable current sources by the agency of the respective current control circuits 15*m*.

Further, when an excessive increase in current causes the voltage to drop, and $V_{m,n}$ becomes lower than the output voltage of the voltage regulator 13, an increase in current is detected by the respective comparators 14*m*, thereby decreasing the current of the respective variable current sources by the agency of the respective current control circuits 15*m*.

Figure 6:
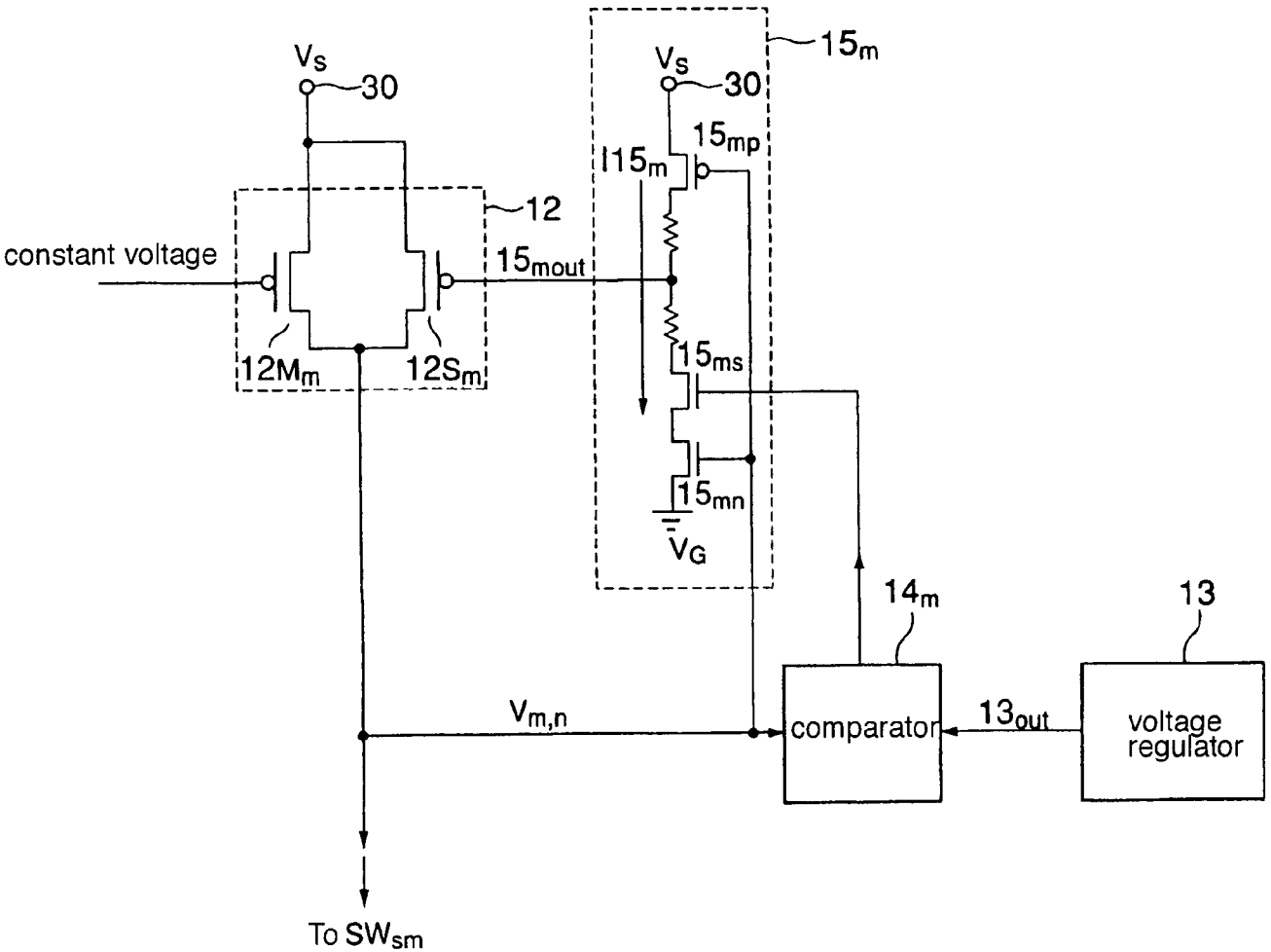
FIG. 6 is a detailed circuit diagram showing a variable current source 12, current control circuit 15*m*, and the periphery thereof, according to the first embodiment of the invention.

FIG. 6 is a detailed circuit diagram showing the variable current source 12, the current control circuit 15*m*, and the periphery thereof. The variable current source 12 comprises a PMOS transistor 12Mm for supplying a constant current at the time of normal constant current operation and a transistor 12Sm for adjustment of the constant current. The PMOS transistor 12Mm generates the constant current by applying a constant voltage to the gate thereof.

The current control circuit 15*m* comprises an NMOS transistor switch 15*ms*, an NMOS resistance 15*mn* with the gate thereof connected to the data line voltage $V_{m,n}$ in common with the gate of a PMOS resistance 15*mp*, and other resistances, and an output 15*m*out of the current control circuit 15*m* is set such that when the switch 15*ms* is ON, the transistor 12Sm can supply necessary current corresponding to the data line voltage $V_{m,n}$ (A resistance ratio of the current control circuit 15*m* is set such that the transistor 12Sm for current adjustment operates in a liner region when it is within a range of the voltage $V_{m,n}$, requiring current adjustment. The output 15*m*out is changed by the NMOS resistance 15*mn* and PMOS resistance 15*mp* changing respective resistance values correspondingly to the voltage $V_{m,n}$, thereby adjusting a current value of the PMOS transistor 12Sm).

When the voltage $V_{m,n}$ of the data line $SEG_m$ becomes higher than an output voltage 13 out of the voltage regulator 13 (that is, when a voltage between the source and drain of the PMOS transistor 12Mm becomes lower, resulting in a decrease of current), the decrease of current is detected by the comparator 14*m* made up of the differential amplifier. The comparator 14*m* turns ON the NMOS transistor switch 15*ms* of the current control circuit 15*m*, whereupon a current 115*m* flows in the current control circuit 15*m*, and the output voltage 15*m*out of the current control circuit 15*m* becomes lower, so that the PMOS transistor 12Sm of the variable current source 12 is turned into ON state, thereby increasing the current of the variable current source 12.

Thus, since the current can be increased or decreased by detecting variation in current, due to insufficiency in potential applied to the current source, the present embodiment is effective for reducing light emission faults of the panel.

Second Embodiment

Figure 5:
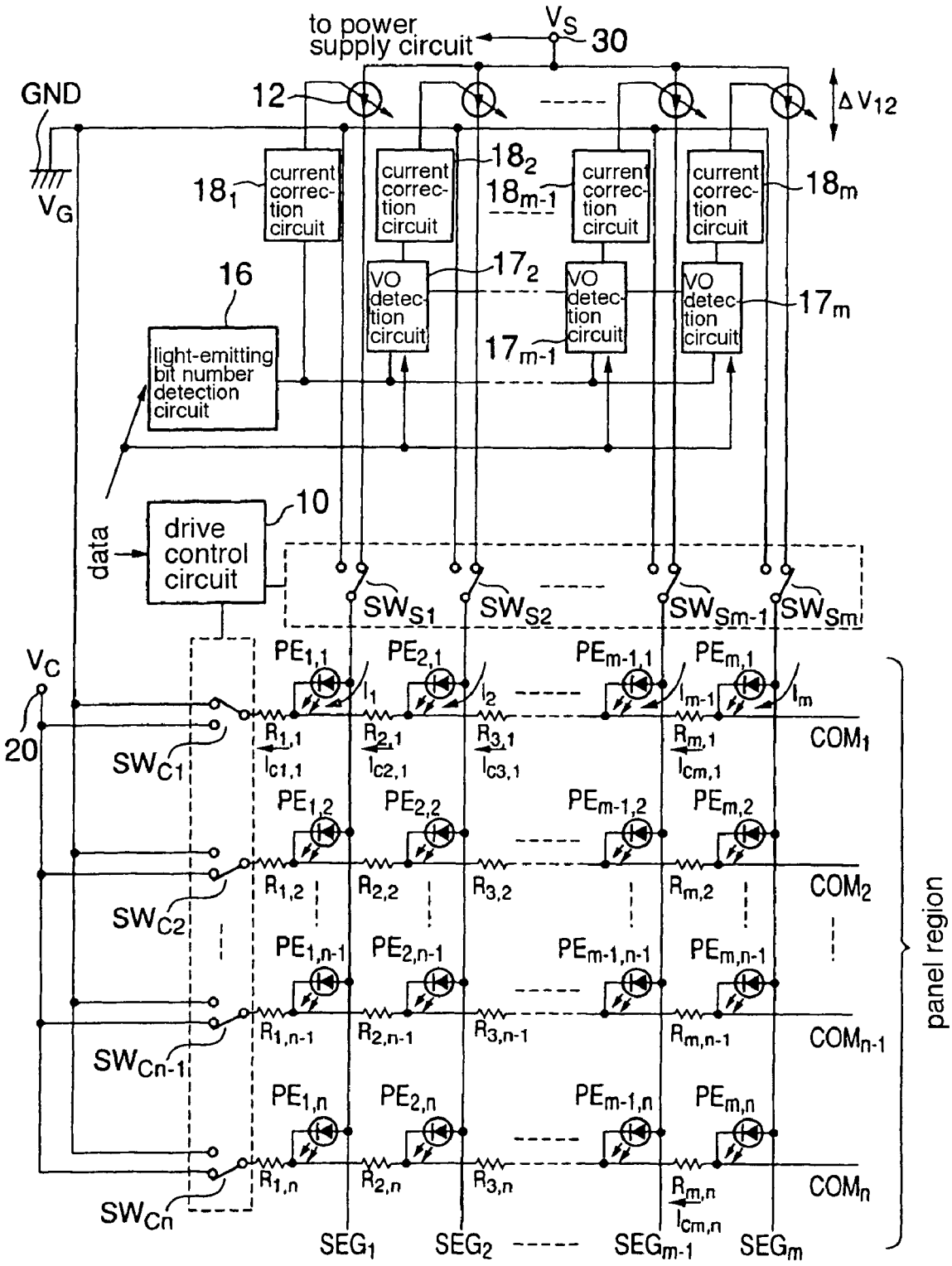
FIG. 5 is a circuit diagram of a drive of a display panel, according to a second embodiment of the invention.

FIG. 5 is a circuit diagram of a drive of a display panel, according to a second embodiment of the invention. As shown in FIG. 5, there is provided a light-emitting bit number detection circuit 16 (which can be made up of, for example, an adder) for detecting the number of light-emitting bits for a succeeding light-emitting period on the basis of data determining light-emission and non light-emission of respective panel elements. Further, there is provided a VO detection circuit 17*m* (which can be made up of, for example, a subtracter and an adder) for assuming and detecting a level of a voltage applied to the panel element for each of data lines $SEG_m$ and the respective VO detection circuits 17*m* are connected with the light-emitting bit number detection circuit 16. The respective VO detection circuits 17*m* are connected to respective current correction circuits 18*m* so as to be able to control current of respective variable current sources 12. The respective current correction circuits 18*m* are preset so as to be able to execute current correction by stages (for example, for every 10 μA) taking into account a voltage ΔV12 applied to the respective variable current sources 12, a panel resistance value, and dependency thereof on a constant current value.

Operation of the circuit of the drive in FIG. 5 is described hereinafter. Normal operation to cause a panel to emit light is executed by turning switching means $SW_{cn}$ of respective scanning lines $COM_n$ON (connected to a grounding potential $V_G$) and OFF (connected to a cathode power supply potential $V_C$) in such a manner as to have operation waveforms shown in FIG. 2 at a predetermined time interval, thereby sequentially selecting panel rows to be lighted. Switching means SWsm of the data line $SEG_m$ connected to a panel element $PE_{m,n}$ to be lighted, in the panel row selected, is turned ON, and current is supplied thereto, whereupon the panel element $PE_{m,n}$ is caused to emit light.

Display data in a display period between time t4 and t5 are normally transferred in a period between time t2 and t3 and are latched before stored in a register, and the light-emitting bit number detection circuit 16 detects the number d of display elements in a subsequent display period from the display data. The respective VO detection circuits 17*m* assume and detect a voltage generated depending on panel resistance for each of the data lines on the basis of the display data.

Assuming that, for example, in case all m bits emit light (d=m) as shown in FIG. 5, resistance of the scanning line $COM_1$ formed of a conductor film, up to the data line $SEG_1$, is $R_{1,1}$, a constant current flowing through the respective data lines is I, a voltage applied to the panel element $PE_{1,1}$, across the resistance, is $V_{1,1}$, a current proportional to the number d of the display elements flows through $R_{1,1}$. That is, $V_{1,1}=R_{1,1}*m*I$.

Similarly, the following equations result:

$$V_{2,1}=V_{1,1}+R_{2,1}*(m-1)*I.$$

$$V_{3,1}=V_{2,1}+R_{3,1}*(m-2)*I.$$

$$V_{4,1}=V_{3,1}+R_{4,1}*(m-3)*I$$

$$V_{5,1}=V_{4,1}+R_{5,1}*(m-4)*I$$

Assuming that resistance $R_{m,n}$ between the respective data lines is all identical, the following equation results:

$$V_{1,1}=\alpha*m(\alpha \text{ is a constant}).$$

Similarly, the following equations result:

$$V_{2,1}=\alpha*(2m-1)$$

$$V_{3,1}=\alpha*(3m-3)$$

$$V_{4,1}=\alpha*(4m-6)$$

$$V_{5,1}=\alpha*(5m-10)$$

Accordingly, only a value A found from $V_{m,n}=\alpha*A$ is sufficient for detection by the respective VO detection circuits 17*m*.

If the value A of any of the data line $SEG_m$ becomes higher than a level value B (the value B is a value pre-calculated from the voltage ΔV12 applied to the respective variable current sources 12, a panel resistance value, and the dependency on the constant current value) set in the current correction circuit 18*m*, the current is increased by +10 μA by the agency of the current correction circuit 18*m*. Further, if the value A of the data line $SEG_m$ becomes higher than a level value C set in the current correction circuit 18*m*, the current is further increased by +10 μA (20 μA in total) by the agency of the current correction circuit 18*m*.

Thus, current correction to be made for a succeeding display period is determined during a preceding display period, thereby enabling a current as desired to be applied immediately upon start of a display period.

Figure 7:
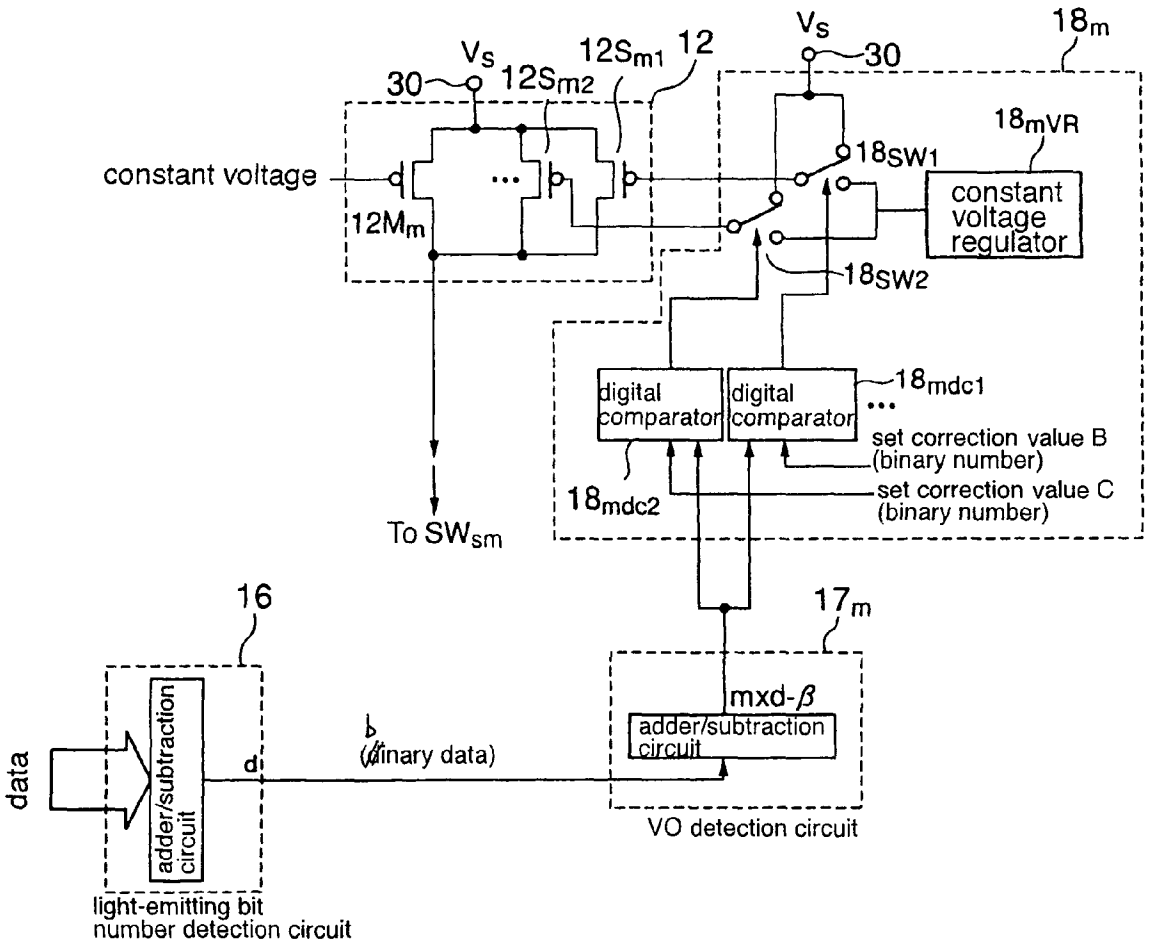
FIG. 7 is a detailed circuit diagram showing a variable current source 12, current correction circuit 18*m*, and the periphery thereof, according to the second embodiment of the invention.

FIG. 7 is a detailed circuit diagram showing the variable current source 12, the current correction circuit 18*m*, and the periphery thereof. The variable current source 12 comprises a current source PMOS transistor 12Mm for supplying the constant current at the time of normal constant current operation and PMOS transistors 12Sm1, 12Sm2, for adjustment of the constant current. The current source PMOS transistor 12Mm generates the constant current by applying a constant voltage to the gate thereof.

The current correction circuit 18*m* comprises a plurality of digital comparators 18*mdc*1, 18*mdc*2 . . . , thereby presetting correction levels B, C, . . . , respectively. Respective outputs of the digital comparators control switching circuits $\mathbf{18}_{SW1}$, $\mathbf{18}_{SW2}$, . . . , respectively, thereby changing over respective voltages of the PMOS transistors 12Sm1, 12Sm2 of the variable current source 12 between a power supply voltage Vs and an output voltage of a constant voltage regulator 18*mvr*. The constant voltage regulator 18*mvr* outputs the voltage for controlling the PMOS transistors 12Sm1, 12Sm2, respectively. This control voltage is set so as to enable, for example, the PMOS transistor 12Sm1 to allow a current of 10 μA to flow therethrough.

The VO detection circuits 17*m* each are provided with an adder-subtractor, executing binary calculation. If a display position corresponds to an m-th bit from the side of the switching means $SW_{cn1}$-$SW_{cn}$, the following calculation is made based on the number d (binary number) of bits, as detected by the light-emitting bit number detection circuit 16:

$$A=m*d-\beta(\beta \text{ is a fixed value determined by m})$$

If, for example, a value A of any of the data lines $SEG_m$ becomes larger than the level value B as set in the current correction circuit 18*m* (that is, it is determined that the voltage $V_{m,n}$ of the data line $SEG_m$ as calculated from the number of the light-emitting elements causes the constant current to decrease), the switching circuit $\mathbf{18}_{SW1}$ is changed over by the comparator $\mathbf{18}_{mdc1}$, and the constant voltage regulator 18*m*VR operates such that the output voltage thereof controls the gate of the PMOS transistors 12Sm1, thereby outputting the constant current.

If the value A of the data line $SEG_m$ becomes larger than the level value C as set in the current correction circuit 18*m* (that is, it is determined that the voltage $V_{m,n}$ of the data line $SEG_m$ calculated from the number of the light-emitting elements causes the constant current to further decrease), the switching circuit $\mathbf{18}_{SW2}$ is changed over by the comparator $\mathbf{18}_{mdc2}$, and the constant voltage regulator $\mathbf{18}_{mvr}$ operates such that the output voltage thereof controls the gate of the PMOS transistors 12Sm2, and a current is further added to the current described above, thereby outputting the constant current.

Thus, since current can be increased by pre-assuming a decrease in current, due to the panel resistance, and detecting the same, it is possible to implement not only stable supply of current during the display period, but also fine adjustment of the current, so that the present embodiment is more effective for reducing light emission faults of the panel.

What is claimed is:

1. A method of driving a display panel made up of (n×m) display elements respectively disposed at different crossover points of a matrix formed of n rows of scanning lines and m columns of data lines, the method comprising variably controlling respective constant current values for driving the respective data lines, wherein said variably controlling the constant current values is implemented by individually comparing a reference voltage with a voltage of each of the respective data lines as driven by the constant current values, using respective comparators each having a first input connected to the reference voltage and a second input connected to a respective one of the data lines, and wherein said variably controlling the constant current values is further implemented by supplying a constant current to the data lines by respective first transistors, and by supplying an adjustment current to the data lines by respective second transistors responsive to control signals output from the comparators.

2. The method of driving a display panel according to claim 1, wherein the display elements are organic EL elements.

3. A drive of a display panel for driving (n×m) display elements respectively disposed at different crossover points of a matrix formed of n rows of scanning lines and m columns of data lines, the display elements each having an anode connected to a respective one of the data lines and a cathode connected to a respective one of the scanning lines, the drive comprising:

first switching means for changing over between connection of the respective data lines to respective variable current sources and connection thereof to ground;

second switching means for changing over a potential of the respective scanning lines between a power supply potential and ground;

driving means for controlling the first switching means and second switching means responsive to input data;

comparison means respectively provided for each of the data lines, said comparison means each having a first input coupled to a respective one of the data lines and for outputting a control signal by comparing a reference voltage from a reference voltage generator with a potential of the respective one of the data lines; and current control means for individually controlling respective current values flowing from the variable current sources to the respective data lines, based on respective results of comparison executed by the comparison means, each of the variable current sources having a first transistor and a second transistor connected to the respective data lines, the first transistors supplying constant currents to the respective data lines, and the second transistors supplying adjustment currents to the respective data lines responsive to the control signals.

4. The drive of a display panel according to claim 3, wherein the comparison means detect a decrease in current of the respective variable current sources based on an increase in potential of the respective data lines to thereby control an increase of the current of the respective variable current sources, and detect an increase in the current of the respective variable current sources based on a drop in the potential of the respective data lines to thereby control a decrease of the current of the respective variable current sources.

5. The drive of a display panel according to claim 3, wherein the display elements are organic EL elements.

6. A drive of a display panel for driving (n×m) display elements respectively disposed at respective crossover points of a matrix formed of n rows of scanning lines and m columns of data lines, the display elements each having an anode connected to a respective one of the data lines and a cathode connected to a respective one of the scanning lines, the drive comprising:

a first switching unit that changes over between connection of the respective data lines to respective variable current sources and connection thereof to ground;

a second switching unit that changes over a potential of the respective scanning lines between a power supply potential and ground;

a drive control circuit that controls the first switching unit and the second switching unit responsive to input data;

comparators respectively provided for each of the data lines, the comparators each having a first input coupled to a respective one of the data lines, the comparators each output control signals by comparing a reference voltage from a voltage regulator with a potential of the respective one of the data lines; and current control circuits respectively provided for each of the data lines, the current control circuits individually control current values flowing from the respective variable current sources to the respective one of the data lines, based on respective results of comparison by the comparators, each of the variable current sources having a first transistor and a second transistor connected to the respective data lines, the first transistors supplying constant currents to the respective data lines and the second transistors supplying adjustment currents to the respective data lines responsive to the control signals.

7. The drive of a display panel according to claim 6, wherein the comparators detect a decrease in the current of the respective variable current sources based on an increase in the potential of the respective data lines to thereby control an increase of the current of the respective variable current sources, and detect an increase in the current of the respective variable current sources based on a drop in the potential of the respective data lines to thereby control a decrease of the current of the respective variable current sources.

* * * * *